US006129810A

United States Patent [19]

Schweitzer et al.

[11] Patent Number: 6,129,810

[45] **Date of Patent: *Oct. 10, 2000**

[54] LINERLESS LABEL DISPENSER

[75] Inventors: James M. Schweitzer, Lancaster; Jimmie A. Harrod, Grand Island; Jeffrey J. Boreali, N. Tonawanda, all of N.Y.

[73] Assignee: Moore Business Forms, Inc., Grand Island, N.Y.

[ * ] Notice: This patent is subject to a terminal disclaimer.

[21] Appl. No.: 08/546,925

[22] Filed: Oct. 23, 1995

Related U.S. Application Data

[63] Continuation-in-part of application No. 08/544,132, Oct. 17, 1995, abandoned.

[51] Int. Cl.[7] ..... B26D 7/00

[52] U.S. Cl. ..... 156/387; 156/510; 83/167; 83/168; 83/86; 83/349; 221/70; 221/71; 400/613; 400/621; 242/613

[58] Field of Search ..... 83/168, 167, 86, 83/349; 221/70, 71; 156/521, 522, 510, 353, 387; 400/621, 613; 242/613

[56] References Cited

U.S. PATENT DOCUMENTS

| | | | |
|---|---|---|---|
| 1,738,076 | 12/1929 | Molins | 83/349 |
| 3,417,681 | 12/1968 | Lemelson | 400/621 |
| 3,433,355 | 3/1969 | Smith | 242/613 |
| 3,587,376 | 6/1971 | Hirano et al. | 83/110 |
| 3,902,954 | 9/1975 | Lotto | 156/510 |
| 3,911,771 | 10/1975 | Schleifenbaum | 83/81 |
| 4,149,484 | 4/1979 | Koch | 112/42 |
| 4,294,145 | 10/1981 | Bodewein | 83/349 |
| 4,297,930 | 11/1981 | Putzke | 83/156 |
| 4,557,169 | 12/1985 | Kajiya et al. | 83/156 |
| 4,759,288 | 7/1988 | Persson | 101/288 |
| 4,840,696 | 6/1989 | Krasuski et al. | 156/353 |
| 4,892,019 | 1/1990 | Kogane et al. | 83/105 |
| 4,900,392 | 2/1990 | Bradshaw et al. | 156/541 |
| 4,972,743 | 11/1990 | Nojima | 83/76.8 |
| 4,978,415 | 12/1990 | Jones | 83/168 |
| 5,133,615 | 7/1992 | Saito et al. | 406/621 |
| 5,267,800 | 12/1993 | Petteruti et al. | 400/88 |
| 5,370,754 | 12/1994 | Soloman | 156/64 |
| 5,375,752 | 12/1994 | Michalovic | 225/2 |
| 5,378,301 | 1/1995 | Boreali et al. | 156/344 |
| 5,417,783 | 5/1995 | Boreali et al. | 156/64 |
| 5,431,763 | 7/1995 | Bradshaw | 156/256 |
| 5,437,228 | 8/1995 | Uland | 101/288 |
| 5,524,996 | 6/1996 | Carpenter et al. | 400/621 |

FOREIGN PATENT DOCUMENTS 0 577 241 A2 1/1994 European Pat. Off. .

*Primary Examiner*—Linda L. Gray
*Attorney, Agent, or Firm*—Nixon & Vanderhye P.C.

[57] ABSTRACT

A dispensing mechanism dispenses labels having a pressure sensitive adhesive face and an adhesive release material coated face. A guide serves to guide the labels in web form along plasma-coated surfaces to a printer and then to a cutter mechanism for forming discrete labels and dispensing the labels. An open-cell foam sponge is provided for wiping the rotary cutter using silicone oil wicked into the wiper. A plate projects from the exit opening of the dispenser at an angle to the guide path to maintain the cut label on the dispenser plate. Additionally, a hub assembly is provided wherein the hub has a contact area in excess of 50% of the available contact area along the inside of the core mounting the label supply.

14 Claims, 4 Drawing Sheets

LINERLESS LABEL DISPENSER

This application is a Continuation-In-Part of application Ser. No. 08/544,132 filed Oct. 17, 1995 for "Linerless Label Cut-Off" abandoned.

BACKGROUND AND SUMMARY OF THE INVENTION

The use of linerless labels is becoming widespread due to relatively low cost of such labels and due to their relative environmental friendliness. A number of different dispensers has been developed—such as shown in the above-mentioned U.S. patent application, U.S. Pat. Nos. 5,375,752 and 5,417,783, European published application 0577241, and co-pending U.S. application Ser. No. 08/312,068 filed Sep. 26, 1994—to facilitate dispensing of such labels. Each of those dispensers is particularly suited for certain dispensing requirements and can successfully dispense linerless labels without prohibitive difficulties. However, there are some circumstances for which such dispensers are not ideally suited, and therefore the linerless label dispenser according to the above-mentioned U.S. patent application—and its associated cutting mechanism—have been developed.

The linerless label dispenser, and its associated cutting mechanism, according to the invention disclosed in the above-identified patent application are ideally suited for dispensing linerless labels from a roll even when the labels are not perforated on the roll. The dispenser can automatically print the labels just prior to dispensing, and dispenses them in a manner that substantially avoids jamming of the printer or the cutting mechanism.

According to one aspect of that invention a linerless label dispenser is provided comprising the following components: A support for a supply of continuous form linerless labels, each label having a pressure sensitive adhesive face and an adhesive-release material coated face. An adhesive-release material guide structure for engaging the adhesive face of labels from the supply of labels. A print head, on the opposite side of the guide structure from the supply of labels, for printing the release material coated face of labels from the supply of labels. A stripper surface, on the opposite side of the print head from the release material structure, the stripper surface of adhesive-release material. A stationary anvil blade, on the opposite side of the stripper surface from the print head, for engaging the adhesive face of labels from the supply of labels. And an automatic rotary cutter cooperating with the stationary anvil blade for engaging the release material coated face of labels from the supply of labels, and cutting individual labels to be dispensed from the supply of continuous form of linerless labels.

The support for the continuous form linerless labels of that invention comprised a conventional shaft mounting a hub about 25% of the length of the core of a roll of linerless labels mounted on the hub. The linerless labels may either be perforated, or may have marks applied thereto indicating the approximate position at which the web of labels from the roll are to be severed into individual labels.

The adhesive-release material guide structure is mounted adjacent a plastic guide which engages the release material face of the labels, and preferably the adhesive-release material thereof is a plasma coating such as disclosed in U.S. Pat. No. 5,375,752, the disclosure of which is hereby incorporated by reference herein.

After the guide structure, the labels typically pass under a sensor which either senses the perforations or marks indicating the division between labels, which cooperates with a control mechanism for the printer and subsequent rotary cutter. The print head may be of any conventional type that is capable of printing on the release material, preferably a non-impact printer such as an ink jet printer. Where a thermosensitive coating is also provided for the labels, the print head may be a thermal print head or a thermal transfer print head. Typically the print head cooperates with a print roller, which may be plasma coated, but preferably is a silicone roller.

Just downstream of the print head is a support which supports the stripper surface and the stationary anvil blade. The adhesive-release material of the stripper surface preferably also is a plasma coating, and the stripper surface is disposed at an upwardly directed (from the print head) angle of between about 20–35° (preferably about 27°) with respect to the horizontal so that the labels printed by the print head move upwardly at an angle from the print head to the rotary cutter. The provision of such an angle has been found to minimize jams of the printer and the cutter. A stripper surface also may have a plurality of upwardly extending extensions formed on at least a part thereof (e.g. a portion of between 5–20% of the width of a linerless label passing thereover) for decreasing the surface tension thereof.

The stationary anvil blade is preferably also coated with a release material such as plasma coatings or textured paint and is immediately adjacent the stripper surface. It has been found according to the present invention that jamming of the printer and rotary cutter are minimized if the anvil blade projects upwardly from a support surface and downwardly spaced for a stripper surface a sufficient distance to insure that the leading edge of the label (the edge being cut) is not smashed. It has been found that being set slightly below the stripper surface in a range between about 0.001–0.008 inches (preferably about 0.002–0.004 inches) is most effective.

The rotary cutter may comprise a conventional off the shelf structure, except for the release coated rotary blade, such as a Hitachi rotary cutter Model #V15A. The release coat may be plasma coatings or textured paint.

Under some circumstances it is desirable to have an exit roller downstream of the rotary cutoff mechanism to facilitate dispensing of the cut labels, such as through an exit opening in a housing. Such an exit roller, when provided, also preferably has a release coated surface, and that surface is also preferably grooved (between about 5–20% of the width of a linerless label engaged thereby) and typically cooperates with a hold down mechanism of any conventional type.

While the dispenser as described in prior application Ser. No. 08/544,132 is considered eminently suitable for its purposes, it has been found that many thermal and other non-impact printers are typically placed on their side due to space constraints or cabinet constructions rather than on their base or vertical axis. Wiper elements are conventionally used to prevent the accumulation of adhesive on the rotary cutting blade. Such wiper elements are typically formed of felt or other cloth material which have a tendency to allow the silicone oil necessary to clean the blade to migrate toward the side of the blade which is face down. That is, the silicone oil migrates toward one end of the wiper due to the forces of gravity. Consequently, an unacceptable situation arises as only part of the blade is being coated with silicone oil while adhesive is allowed to build up on another part of the blade. This requires cleaning or replacement of the blade, as well as replacement or refilling of the wiper element.

According to the present invention, it has been discovered that an open-celled foam wiper or sponge retains the silicone oil substantially across the entirety of its surface such that the silicone oil is applied to the entire surface of the blade notwithstanding an orientation of the rotary cutter and wiper other than horizontally as intended. It is believed that the enhanced wicking action of the foam material maintains the silicone oil along the entire surface of the wiper element whether it extends horizontally or vertically. Thus, the open-celled foam material is the material of choice for the wiper element due to its superior wicking ability.

A further difficulty with linerless label dispensers resides in the tendency of exit rollers of printers to continue to drive the label after the label has been severed from the web by a cutter. If there is insufficient area for the label to rest at the exit port of the housing, then the label can simply fall out of the printer requiring the user to pick the label up off the floor. If the adhesive side falls face down, the label is lost and the user has to print a second label and take the time to remove the label from the floor. Also, the label may catch itself on the exterior of the housing and then swing into contact with the housing itself. This causes the label to stick to the outside of the housing and repeated instances can cause blockage of the exit port of the housing.

In accordance with the present invention and to alleviate that problem, the exit port of the printer housing is provided with a plate which not only provides a surface area for the label to rest until needed but also serves to lift the label slightly from the guide path of the labels egressing from the printer to avoid the problem of the label getting caught and swinging down into contact with the housing. The upward angle of the plate extends within a range of 5° to about 25° relative to the guide path and an optimum angle is about 10–20°. Thus, an obtuse angle of approximately 155° to 175° with a preferred obtuse angle of 160–170° is provided relative to the path of movement of the label exiting the housing. The plate may extend from the housing about ½ inch but longer or shorter lengths of plates can be used depending upon the length of the label. The plate can either be coated with a plasma coating or, more preferably, with a textured paint which prevents the label from sticking to the surface. Because the plate is not an active transport surface for the label material, a textured paint rather than a plasma coating is preferred. The textured paint affords a release surface but not as great a release surface as that provided by a plasma coating. Thus, the label can beneficially cling to the plate having the textured paint coating yet can be easily removed when needed. If the printer is orientated on its side, the label is ejected from the printer and grasps the plate so that it is still substantially perpendicular to the floor thus facilitating grasping of the label.

In another aspect of the present invention, feeding linered base material through a printer from a supply has not caused problems for the supply to track through the printer because the stock simply unwinds itself due to the low coefficient of friction created by the release liner. Thus, the label supply would not wobble nor would the label stock skew when entering the printing section of the printer. Many conventional label printers are provided with a shaft on which a small hub is provided to accommodate the label material. The size of the hub did not matter with the liner-based stock as there was no additional forces applied to the stock. Thus, a very small hub, having a contacting area approximately 25% of the contact area of the core of the supply of linered stock, was typically provided. However, this standard hub did not operate satisfactorily in a linerless environment.

Linerless labels, due to the absence of the release layer, have a substantially increased peeling force to remove the label material from the next layer of labels due to the pressure sensitive adhesive face on the supply. This creates an additional force which causes tracking problems within the printer. Thus, the linerless label material would sometimes be skewed when it entered the printhead or may contact coated face of linerless labels and cutting the labels and a plate carried by the housing and extending outwardly of the exit opening, the plate being angled to form an obtuse angle with the predetermined path and lying along the pressure sensitive adhesive face of the linerless label passing through the exit opening.

In a further preferred embodiment according to the present invention, there is provided a cutting mechanism for linerless labels each having a pressure sensitive adhesive face and an adhesive-release material coated face, the mechanism comprising a stripper surface of adhesive-release material for engaging the adhesive face of linerless labels, an anvil blade adjacent the stripper surface for engaging one of the adhesive face and release material coated face of linerless labels, a rotary cutter cooperating with the blade for engaging another of the adhesive face and the release material coated face of linerless labels and cutting the labels and a wiper impregnated with silicone oil for wiping the rotary cutter to prevent build up of adhesive on the rotary cutter, the wiper being formed of an open-cell foam material.

In a still further preferred embodiment according to the present invention, there is provided a linerless label dispenser comprising a support for a supply of continuous form linerless labels wound on a core, each label having a pressure sensitive adhesive face and an adhesive-release material coated face, the support including a hub mounted for rotation and having a contact area with the core in excess of 50% of the area of the core of the supply of linerless labels, a guide structure for engaging the labels from the supply of labels, a printhead, on the opposite side of the guide structure from the supply of labels, for surfaces beyond the active transport surfaces which are not protected with release coatings so that the label material may stick to the unprotected portions of the dispenser.

In accordance with the present invention, an adapter hub is provided on the shaft so that the contact area between the adapter hub and the conventional machine hub with the inside diameter of the core of the linerless label supply is in excess of 50% of the area of the core of the label supply. Thus, by adding an additional hub, the problem of skewing and tracking of the supply label through the dispenser and printer can be eliminated. The area covered by the hub can be as high as 100% of the area of the core but a hub combination which covers up to about 75% of the surface area works well. Additionally, because of the different sizes of the labels, an adapter hub which increases the contact area to 75%, for example, for a 4 inch wide label web, may fit a 3 inch wide label led affording 100% contact area. Consequently, a single adapter hub may serve a number of different sizes of cores.

In a preferred embodiment according to the present invention, there is provided a dispensing mechanism for linerless labels each having a pressure sensitive adhesive face and an adhesive-release material coated face, the mechanism comprising a housing defining a guide path for linerless labels including a stripper surface of adhesive-release material for engaging the adhesive face of linerless labels and an exit opening for supplying linerless labels from the mechanism along a predetermined path, an anvil blade adjacent the stripper surface for engaging the adhesive face of linerless labels, a cutter cooperating with the anvil blade for engaging the release material printing the release material coated face of the labels from the supply of labels, a stripper surface on the opposite side of the printhead from the release material structure, and formed of adhesive-release material, an anvil blade, on the opposite side of the stripper surface from the printhead, for engaging one of the adhesive release material coated face and the pressure sensitive adhesive face of labels from the supply of labels and a rotatory cutter cooperating with the anvil blade for engaging another of the adhesive-release material coated face and the pressure sensitive adhesive face of labels from the supply of labels, and cutting individual labels to be dispensed from the supply of continuous form of linerless labels.

It is a primary object of the present invention to provide an effective linerless label dispenser and a cutting mechanism for use therewith. This and other objects of the invention will become clear from an inspection of the detailed description of the invention, and from the appended claims.

DETAILED DESCRIPTION OF THE DRAWINGS

Figure 1:
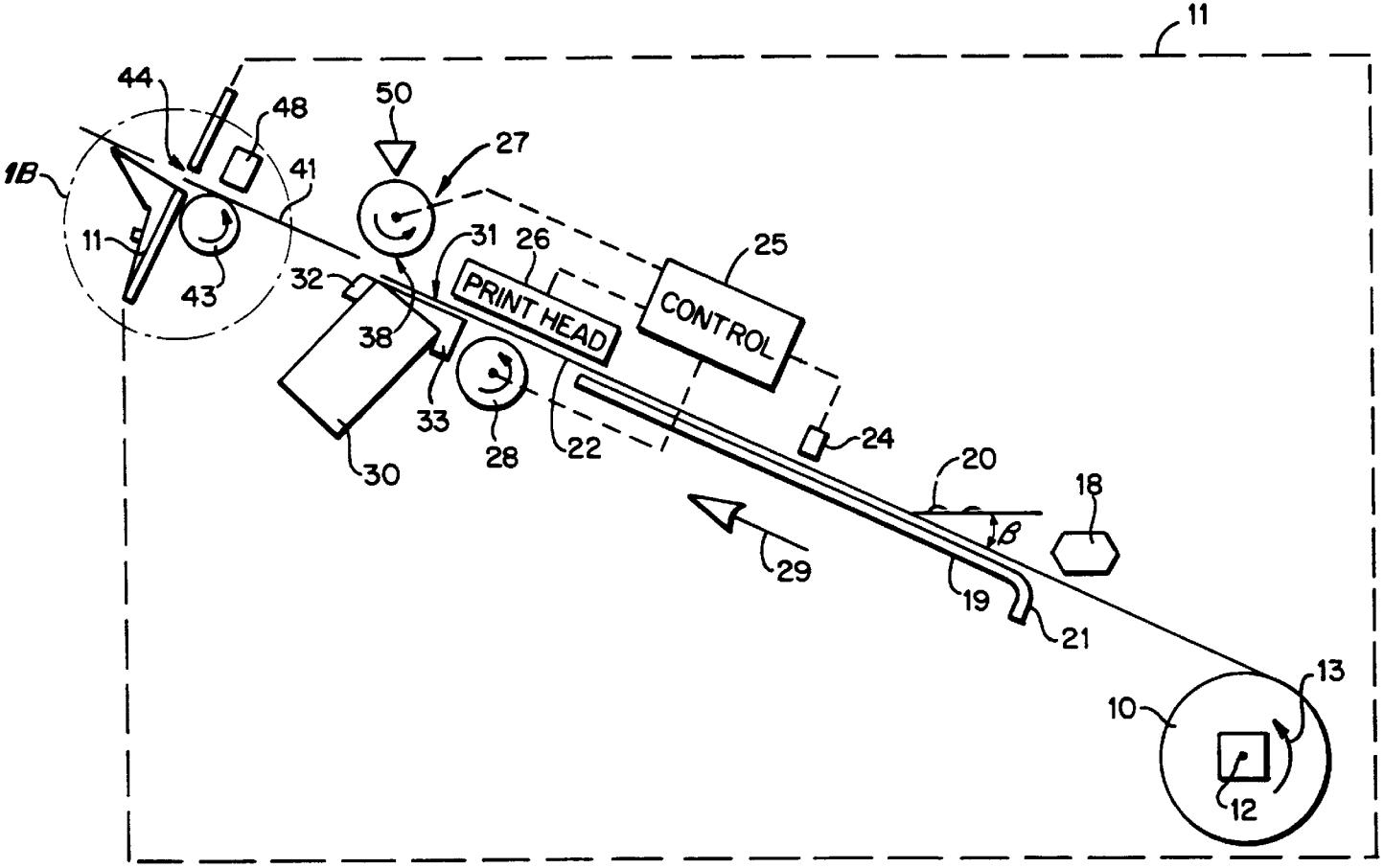
FIG. 1 is a side schematic view of an exemplary linerless label dispenser according to the present invention.

FIG. 1 schematically illustrates an exemplary dispenser that may be provided according to the present invention for dispensing linerless labels e.g. in a roll 10 which is a supply of continuous form linerless labels. The linerless labels in the roll 10 may either have perforations between the labels, or may be devoid of perforations. Sensor marks may be provided so that where a label begins and ends may be determined. The dispenser illustrated in FIG. 1 may include a common housing shown merely in dotted lines schematically at 11 in FIG. 1.

The supply of linerless labels 10 is mounted on a support. The support is illustrated only schematically at 12 in FIG. 1 and in detail in FIG. 1A described hereafter. The roll 10 rotates in a direction indicated by arrow 13 as the labels are taken off the roll 10, decreasing in size. The linerless labels forming the roll 10 are—as is common for all linerless labels—formed by (see the schematic illustration in FIG. 3) a substrate 14, typically of paper, with a pressure sensitive adhesive coating 15 on one face thereof and an adhesive release material coating (e.g. silicone) 16 on the other face thereof.

From the roll 10 the linerless labels preferably pass underneath a plastic guide 18 which engages the release material coating 16 face thereof, and then to an adhesive-release material guide structure 19 which engages the adhesive face 15. Preferably the structure 19 comprises a plasma coated ramp, for example disposed at an angle β with respect to the horizontal (indicated at 20 in FIG. 1). The angle β is typically between about 20–35° (e.g. about 27°). The ramp 19 preferably includes an arcuate lead-in portion 21.

Linerless labels in continuous form, illustrated schematically at 22 in the drawings, typically pass underneath the sensor 24, such as a conventional optical sensor. The sensor 24 senses either the perforation lines between individual labels of the web 22, or applied marks for that purpose indicating the demarcation between labels. Sensor 24 may cooperate with a computer control 25 or the like, computer control 25 also typically controlling a print head illustrated schematically at 26 in FIG. 1, and a rotary cutter, illustrated schematically at 27 in FIG. 1, and in more detail in FIG. 2. After receiving input from sensor 24 the control 25 properly controls the print head 26 and cutter 27.

The print head 26 cooperates with the release material face 16 of the web 22 to print indicia thereon, typically variable indicia under the control of the computer control 25. The printer 26 may be any suitable type that can print on the release material face 16, such as a non-impact printer like an ink jet printer. Where the web 22 comprises linerless labels with a thermosensitive coat beneath a release coating 16, or surrounded thereby (as is conventional in the art), the print head 26 may be a thermal or thermal transfer print head. Normally the print head 26 cooperates with the print roller 28, which is a silicone roller but may also be plasma coated so as to have adhesive-release properties.

Figure 2:
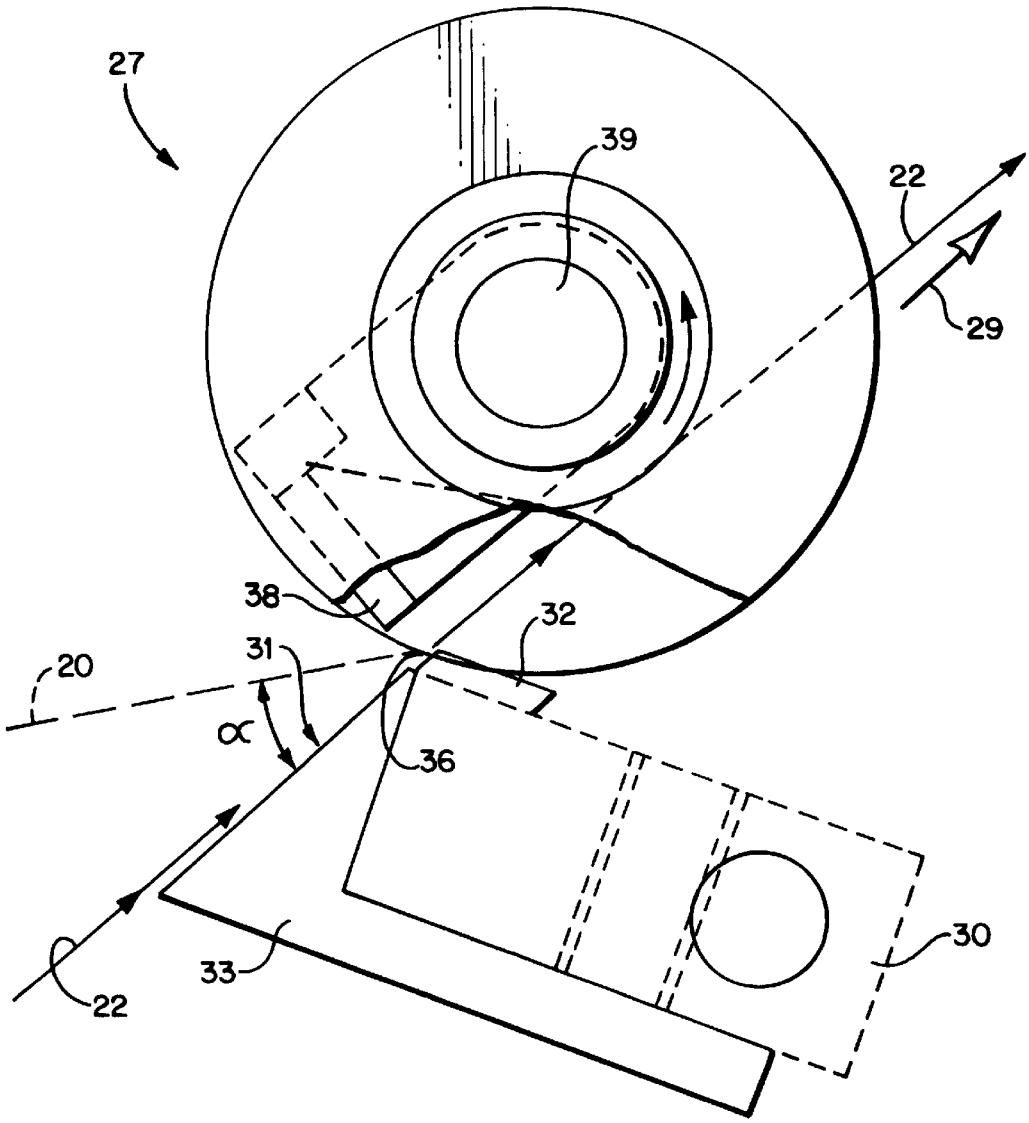
FIG. 2 is a detail side elevational view, with portions cut away for clarity of illustration, of the stripper surface and cutting mechanism of the dispenser of FIG. 1.

Downstream in the direction of movement of the label 22, which direction is illustrated by the arrow 29 in FIGS. 1 and 2, is a support 30. The support 30 preferably supports a stripper surface 31, seen in FIGS. 1 through 3, and a stationary anvil blade 32. The stripper surface 31 is preferably a generally planar surface of a block or other shape of metal 33, the surface 31 being plasma coated so that it will not stick to the adhesive 15 which it engages. The stripper surface 31 is disposed at the angle α (see FIG. 2) with respect to the horizontal 20, the angle α typically being about the same as the angle β that is between about 20–35°, preferably about 27°. As seen in FIGS. 1 and 2, the surface 31 is upwardly directed from the print head 26 toward the rotary cutting mechanism 27, which has been found to minimize jamming.

Figure 3:
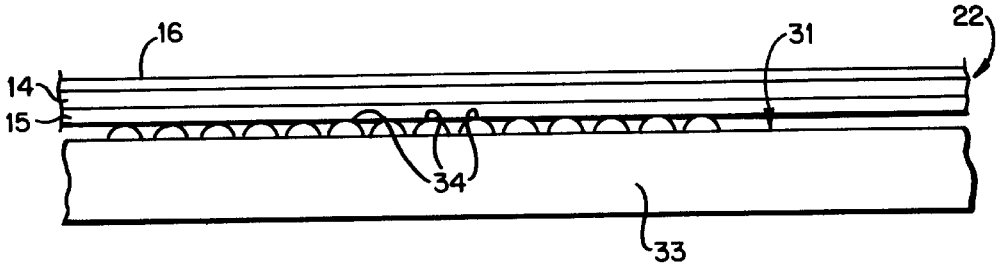
FIG. 3 is an enlarged partial front end view of the stripper surface of FIGS. 1 and 2 showing the linerless label, also enlarged for clarity of illustration, in association therewith.

As illustrated schematically in FIG. 3, the surface 31 may include a plurality of upwardly extending extensions 34 formed on at least a part thereof. For example, twenty such extensions 34 may be formed on the surface 31, the total extent of the extensions 34 being between about 5–20% of the width of the linerless label 22 passing thereover. The purpose of the extensions 34 (which are also plasma coated) is to decrease the surface tension of the stripper surface 31 and thereby minimize the possibility of the adhesive sticking thereto. While the extensions 34 are illustrated as dimples in FIG. 3, they may have any desired operable configuration and relative dimensions.

Immediately downstream of the stripper surface 31 is the anvil blade 32. The anvil blade 32 is of hardened steel or the like, and preferably also is plasma coated or covered by textured paint, at least the portions thereof that are likely to come into contact with the adhesive of labels being cut. The hardened blade 32 has a portion 36 thereof which projects upwardly from the support 30 a distance t and downwardly from the stripper surface 31 at distance s. The amount of upward and downward spacing is preferably between about 0.001–0.008 inches, most preferably between about 0.002–0.004 inches. It has been found that this slight, but significant, projection of the portion 36 of the blade 32 also minimizes jamming of the entire dispenser, particularly the print head 26 and the rotary cutter 27.

The rotary cutter 27 typically includes a rotary blade 38 mounted on a rotating, powered, shaft 39 (e.g. typically powered by an electrical motor under the control of computer control 25). The rotary blade 38—even though it initially engages only the release material face 16 of the web 22—may also be plasma coated. Preferably, however, the blade 38 may be coated with a textured paint or varnish. The blade 38 cooperates with the blade 32 to sever the linerless label web 22 into individual labels, such as the individual label 41 illustrated schematically in FIG. 1 downstream of the rotary cutter mechanism 27 in the direction 29. The rotary cutting mechanism 27 may be an off-the-shelf rotary cutter, such as a Hitachi rotary cutter Model #V15A and provided with a release coating such as textured paint or the like.

In order to even further prevent sticking of the adhesive 15 of the web 22 to the anvil blade 32, after a cut is made the web 22 may be retracted slightly (moved in a direction opposite the direction 29), on the order of about one-eighth to one inch. This would be accomplished by the computer control 25 reversing the direction of the print roll 28, or reversing the direction of other conveyance mechanisms (such as rollers, belts, or the like) that may be associated with the dispenser of FIG. 1, but are not illustrated in FIG. 1.

Figure 4:
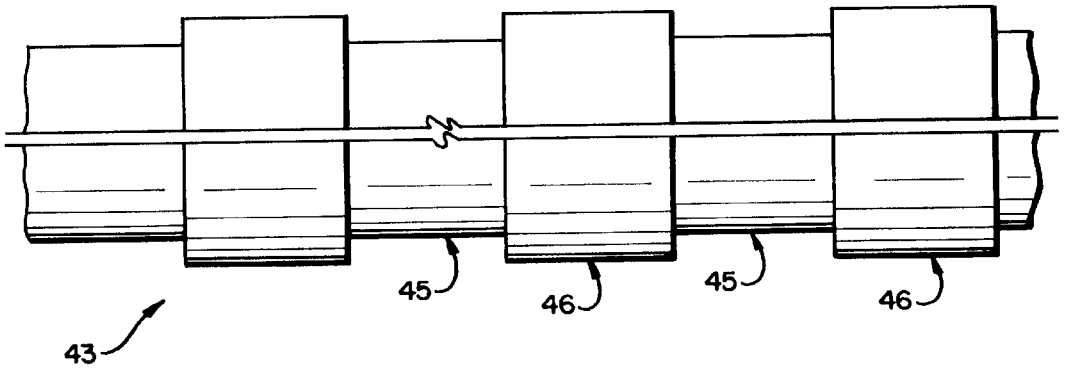
FIG. 4 is a partial front end view of an exemplary construction of an exit roller of the dispenser of FIG. 1.

Downstream of the cutter 27 an exit roller 43 may be provided. While the exit roller 43 is not essential, it does help in dispensing cut labels 41 through an exit opening 44 in the housing 11. The exit roller 43 also is preferably plasma coated, and since it is very important the labels not stick to it (since that would preclude dispensing thereof through the opening 44), the plasma coated surface of the roller 43 may be grooved to reduce the overall surface tension of the roller 43. One configuration the grooving might take is illustrated schematically in FIG. 4 where annular depressions 45 are provided between annular lands 46. The grooving of the roller 43 need not necessarily be over the entire width thereof, but—as with the extension 34 of the surface 31—may be provided over a portion equal to about 5–20% of a width of a linerless label passing thereover.

The exit roller 43 may cooperate with a conventional hold down mechanism, illustrated only schematically at 48 in FIG. 1. The hold down mechanism may be of any conventional type, engaging the release material coated face 16 of the label 41. For example, it may be another roller either gravity or spring pressed into place, or a low friction material slide either gravity or spring pressed into place, or spring fingers exerting light downward pressure, or other conventional mechanisms.

With respect to all of the adhesive release surfaces described above it is preferred that they are plasma coated. However, under some circumstances they may comprise other release materials, such as silicone coatings.

Referring back now to FIG. 1, it will be appreciated that there is the possibility of a build up of adhesive on the rotary cutter blade 38 and that wipers formed of traditional felt or cloth containing silicone oil have previously been used to maintain the cutter blade free of adhesive build up. However, because of the possibility of different orientations of the dispenser, it has been found that the silicone oil, with such conventional wiper elements, is not applied uniformly or at all along portions of the wiper in other than horizontal orientations of the dispenser. To enable the entirety of blade 38 to be continuously cleaned with a wiper element containing silicone oil, the wiper element 50 of the present invention is formed of an open-celled foam sponge-like material. The foam material retains the silicone oil substantially uniformly across its entire surface due to its superior wicking action notwithstanding changes in orientation of the wiper. That is, even with the wiper element on its side, the wicking action of the foam material will pull the silicone oil from any pool or source of oil such that it may be substantially uniformly applied across the cutter blade 38 to maintain the latter clear of adhesive residue.

Figure 1A:
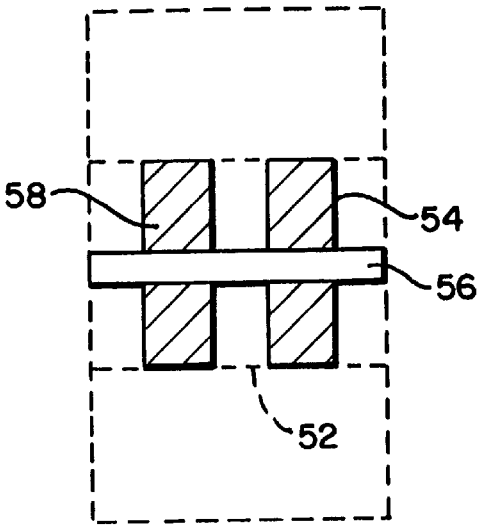
FIG. 1A is an enlarged cross sectional view illustrating the mounting of the core for the supply of linerless labels on the shaft of the dispenser.
Figure 1B:
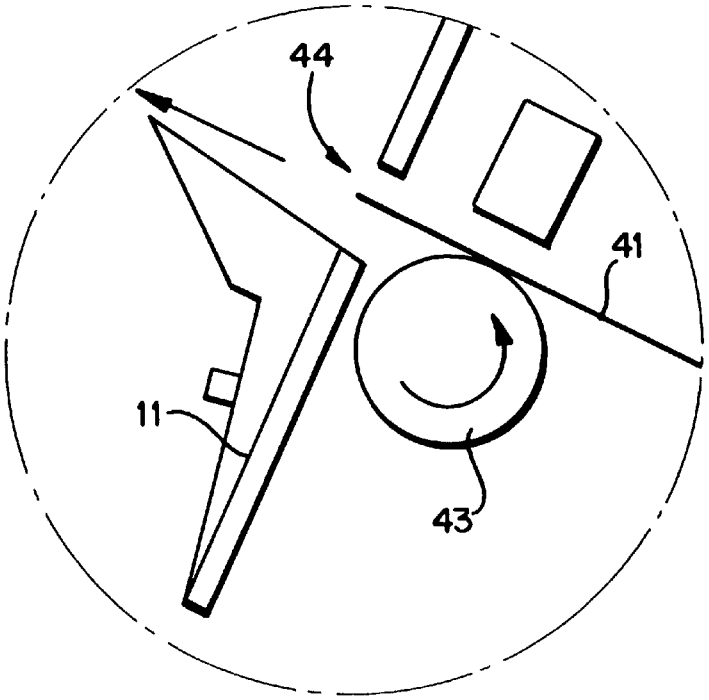
FIG. 1B is an enlarged view of the exit opening of the dispenser illustrating the angled plate.

Referring to FIG. 1A, there is illustrated a mounting for the supply of labels 10. Typically, labels 10 are supplied in roll form about a core 52 preferably formed of a cardboard material. In prior liner-labelled constructions, a single hub 54 was mounted on a shaft 56 forming part of the dispenser. The hub was typically approximately 25% of the length, i.e., had a contact area approximately 25% of the contact area available on the interior surface of the core 52. Tracking, wobbling or skewing problems did not occur in the linered labels. However, because the peel strength of linerless labels is substantially greater than the peel strength of linered labels, it has been found that this arrangement does in fact cause skewing and out of track movement of the labels as they pass through the dispenser. To preclude this, an additional adapter hub 58 is provided on the axle 56. The adapter hub 58 has the same diameter as the conventional hub 54. However, the two hubs combined provide a contact area in excess of 50% of the available contact area along the inside of the core 52. The area covered by the hubs can be as high as 100% of the area of the core but it has been found that a hub combination which covers up to 75% of the available area of the core works well.

It will thus be seen that according to the present invention a simple yet versatile yet effective linerless label dispenser, and cutting mechanism for linerless labels, have been provided. While the invention has been herein shown and described in what is presently conceived to be the most practical and preferred embodiment thereof, it will be apparent to those ordinary skill in the art that many modifications may be made thereof within the scope of the invention, which scope is to be accorded the broadest interpretation of the appended claims so as to encompass all equivalent structures and devices.

What is claimed is:

1. A dispensing mechanism for linerless labels each having a pressure sensitive adhesive face and an adhesive-release material coated face, said mechanism comprising:

a housing defining a guide path for said linerless labels including a stripper surface of adhesive-release material for engaging the pressure sensitive adhesive face of said linerless labels and an exit opening for supplying linerless labels from said mechanism along a predetermined path;

an anvil blade adjacent said stripper surface for engaging the pressure sensitive adhesive face of said linerless labels;

a cutter cooperating with said anvil blade for engaging the release material coated face of said linerless labels and cutting the labels; and a plate carried by said housing and extending outwardly of said exit opening, said plate being angled to form an obtuse angle with the predetermined path and lying along the pressure sensitive adhesive face of the linerless label passing through the exit opening for deviating the label from said predetermined path by contact with the pressure sensitive adhesive face of the label.

2. A mechanism according to claim 1 wherein said cutter includes a rotary blade, and wherein said anvil blade is stationary, said stationary anvil blade and said rotary blade being plasma coated.

3. A mechanism according to claim 1 wherein said anvil blade is stationary and is spaced below said stripper surface a distance of 0.001–0.008 inches, and is immediately adjacent said stripper surface.

4. A mechanism according to claim 1 wherein said obtuse angle is between 160°–175°.

5. A mechanism according to claim 1 wherein said obtuse angle is between 155°–170°.

6. A mechanism according to claim 1 wherein said plate has a plasma coated surface for contacting the linerless labels along the pressure sensitive adhesive face thereof.

7. A mechanism according to claim 1 wherein said plate has a surface coated with a textured paint for contacting the linerless labels on the pressure sensitive adhesive face thereof.

8. A cutting mechanism for linerless labels each having a pressure sensitive adhesive face and an adhesive-release material coated face, said mechanism comprising:

a stripper surface of adhesive-release material for engaging the pressure sensitive adhesive face of said linerless labels;

an anvil blade adjacent said stripper surface for engaging one of the pressure sensitive adhesive face and release material coated face of said linerless labels;

a rotary cutter cooperating with said blade for engaging another of the pressure sensitive adhesive face and the release material coated face of linerless labels and cutting the labels; and a wiper impregnated with silicone oil for wiping the rotary cutter to prevent build up of adhesive on the rotary cutter, said wiper being formed of an open-cell material.

9. A mechanism according to claim 8 wherein said rotary cutter includes a rotary blade, said anvil blade being stationary, said stationary blade and said rotary blade being plasma coated.

10. A mechanism according to claim 8 wherein said anvil blade is stationary and is spaced below said stripper surface a distance of about 0.001–0.008 inches and is immediately adjacent said stripper surface.

11. A mechanism according to claim 10 wherein said stripper surface is disposed at an angle between 20–35° to a horizontal direction and said anvil blade is stationary and is spaced below said stripper surface between about 0.002–0.004 inches.

12. A linerless label dispenser comprising:

a support for a supply of continuous form linerless labels wound on a core, each label having a pressure sensitive adhesive face and an adhesive-release material coated face, said support including a hub mounted for rotation and having a contact area with the core in excess of 50% of the area of the core of said supply of linerless labels;

a guide structure for engaging the labels from said supply of labels;

a printhead, on the opposite side of said guide structure from said supply of labels, for printing the release material coated face of the labels from said supply of labels;

a stripper surface on the opposite side of said printhead from said guide formed of adhesive-release material;

an anvil blade, on the opposite side of said stripper surface from said printhead, for engaging one of the adhesive release material coated face and the pressure sensitive adhesive face of labels from said supply of labels; and a rotatory cutter cooperating with said anvil blade for engaging another of the adhesive-release material coated face and the pressure sensitive adhesive face of labels from said supply of labels, and cutting individual labels to be dispensed from said supply of continuous form of linerless labels.

13. The dispenser according to claim 12 wherein said hub has a contact area with the core in excess of 75% of the area of the core of said supply of linerless labels.

14. A mechanism according to claim 1 including a surface on said plate enabling the label with its adhesive side facing the plate to cling to the plate.

* * * * *